US011566462B2

(12) United States Patent
Yoon

(10) Patent No.: US 11,566,462 B2
(45) Date of Patent: Jan. 31, 2023

(54) SAFETY SYSTEM FOR AUTOMATIC DOOR

(71) Applicant: Il Shik Yoon, Seoul (KR)

(72) Inventor: Il Shik Yoon, Seoul (KR)

( * ) Notice: Subject to any disclaimer, the term of this patent is extended or adjusted under 35 U.S.C. 154(b) by 0 days.

(21) Appl. No.: 17/439,750

(22) PCT Filed: Mar. 24, 2020

(86) PCT No.: PCT/KR2020/003985
§ 371 (c)(1),
(2) Date: Sep. 15, 2021

(87) PCT Pub. No.: WO2020/197234
PCT Pub. Date: Oct. 1, 2020

(65) Prior Publication Data

US 2022/0090432 A1 Mar. 24, 2022

(30) Foreign Application Priority Data

Mar. 25, 2019 (KR) ..... 10-2019-0033694

(51) Int. Cl.
*E05F 15/43* (2015.01)
*E06B 7/23* (2006.01)
*E06B 7/36* (2006.01)

(52) U.S. Cl.
CPC ..... *E05F 15/43* (2015.01); *E06B 7/2305* (2013.01); *E06B 7/36* (2013.01); *E05Y 2800/41* (2013.01)

(58) Field of Classification Search
CPC ..... E05F 15/42; E05F 15/43; E06B 7/2305; E06B 7/36; B66B 13/24; B66B 13/26
USPC ..... 49/26, 27
See application file for complete search history.

(56) References Cited

U.S. PATENT DOCUMENTS

| | | | | |
|---|---|---|---|---|
| 2,687,455 A * | 8/1954 | Norman | E05F 15/48 49/27 |
| 6,223,467 B1 * | 5/2001 | Mahalek | E05F 15/443 49/27 |
| 2002/0152686 A1 * | 10/2002 | Whitehead | B60Q 3/208 49/475.1 |
| 2005/0073852 A1 * | 4/2005 | Ward | B60Q 1/305 362/501 |

FOREIGN PATENT DOCUMENTS

| | | |
|---|---|---|
| DE | 44 17 583 | * 11/1995 |
| EP | 0 916 795 | * 5/1999 |
| JP | 2006213513 | 8/2006 |
| KR | 100916467 | 9/2009 |
| KR | 20140033795 | 3/2014 |
| KR | 101732337 | 5/2017 |
| KR | 101920178 | 11/2018 |
| WO | WO 2018/155840 | * 8/2018 |

OTHER PUBLICATIONS

Written Opinion of the International Searching Authority dated Jun. 30, 2020 from IA PCT/KR2020/003985.

* cited by examiner

*Primary Examiner* — Gregory J Strimbu
(74) *Attorney, Agent, or Firm* — Crockett & Crockett, PC; K. David Crockett, Esq.; Niky Economy Syrangles, Esq.

(57) ABSTRACT

A safety system for an automatic door including an ultrasonic sensor installed in a rotary frame to detect motion of the rotary frame in order to stop operation of an automatic door in order to prevent injury from the door.

4 Claims, 5 Drawing Sheets

SAFETY SYSTEM FOR AUTOMATIC DOOR

FIELD OF THE INVENTIONS

The present invention relates to a safety system for an automatic door, and more particularly, to a safety system configured to prevent a finger from getting jammed in a gap between an automatic door and a door frame and stop an operation of the automatic door when the automatic door is caught by an obstacle.

BACKGROUND OF THE INVENTIONS

An automatic door, which is usually a glass door, is automatically opened when a person's approach is detected or when a person pushes an opening switch, which is often in the form of a push switch, installed on a column disposed beside the automatic door.

The automatic door, which is automatically opened, is spaced apart from a doorframe at an interval (hereinafter, referred to as a 'gap'). Outside cold air is often introduced into a warm interior through the gap or a contact portion between the automatic door and the doorframe even when the automatic door is closed. The cold air decreases an indoor temperature.

In addition, in the case of a single or two automatic doors, when a person, an animal, or an obstacle (hereinafter, referred to collectively as an 'object') gets jammed while the automatic door is being closed, impact is applied to the object.

Like doors of an elevator, an object, particularly, a person's hand or finger may get jammed in a gap while the automatic door is moving. Because the finger may be injured in this case, the operation of the automatic door needs to be stopped immediately after the finger or object gets jammed in the gap. However, the current automatic door rarely has this function.

In addition, because the automatic door mostly has transparent glass, which makes it difficult for a person to recognize, with the naked eye, a state in which the automatic door is moving. As a result, it is difficult to prevent a person from colliding with the moving automatic door or inhibit a person's finger from getting jammed.

SUMMARY

Technical Problem

The present invention has been contrived in consideration of the above-mentioned problems in the related art, and a main object of the present invention is to prevent a person's finger from getting jammed in a gap and inhibit outside air from being introduced into an interior through the gap and a contact portion of an automatic door.

Another object of the present invention is to detect whether an object is caught by a moving automatic door, and immediately stop an operation of the automatic door or rotate the automatic door reversely when an object is caught by the automatic door, thereby protecting an object.

Still another object of the present invention is to enable a person to easily check an operating state of an automatic door from the outside and thus recognize in advance a motion of the automatic door, thereby preventing an accident.

Technical Solution

To achieve the objects, the present invention provides a safety system for an automatic door, which prevents a safety accident when a door D1, which is disposed at a gap d from a doorframe 10, configured to slide, and made of a plate shaped material, is opened or closed while sliding relative to a column 20 on which a push switch for opening the door D1 is installed, the safety system including: a first switch means S1 installed along a front edge of the door D1, in which the first switch means S1 includes: a first stationary frame 100 fixed to the door and configured to surround the front edge of the door D1; a first rotary frame 110 configured to hingedly rotate relative to the first stationary frame; and first detection means 120 installed in the first rotary frame 110 and configured to detect a motion of the first rotary frame, in which the first rotary frame 110 extends along a part or an entirety of a length of a front edge of the first stationary frame 100, one end 112 of the first rotary frame 110 is rotatably coupled to the first stationary frame and defines a rotation axis of the first rotary frame to enable the first rotary frame to hingedly rotate relative to the first stationary frame, and the other end 114 of the first rotary frame 110 is disposed to enable the first rotary frame 110 to move relative to the front edge of the first stationary frame, in which when a front edge of the first rotary frame 110 collides with an external object and the first rotary frame 110 rotates about one end 112 which is the rotation axis, the first detection means 120 detects the rotational motion and transmits a detected signal to an automatic door controller to stop an operation of the automatic door or rotate the automatic door reversely.

In the present invention, the first rotary frame 110 may have a cross-section with an arc shape in a top plan view, and the first detection means 120 may be disposed at predetermined intervals along the front edge of the first stationary frame 100 or the front edge of the first rotary frame 110.

In addition, the safety system may further include an elastic protruding portion 130 installed at a front end of the first rotary frame 110, in which the elastic protruding portion 130 extends along the front end of the first rotary frame 110 and performs a windproof function while absorbing impact by being deformed when the elastic protruding portion 130 collides with an object.

The safety system according to the present invention may further include: a second switch means S2 installed at a front end of the doorframe 10 to cover the gap d between the surface of the door D1 and the front end of the doorframe 10, in which the second switch means S2 includes, in a top plan view: a second stationary frame 200 fixed to the doorframe, configured to surround the front edge of the doorframe 10, and having a fixing plate 202 disposed to be perpendicular to the doorframe and protruding toward the door D1; a gap covering plate 210 movably installed on the fixing plate 202 of the second stationary frame 200 and configured as an elastic body; a second rotary frame 230 installed on the fixing plate 202, having the same structure as the first rotary frame 110, and configured to hingedly rotate relative to the fixing plate 202; and second detection means 240 installed in the second rotary frame 230 and configured to detect a motion of the second rotary frame 230, in which a plurality of long holes, which is elongated in a direction perpendicular to the door D1, is formed in at least one of the fixing plate 202 and the gap covering plate 210, and the gap covering plate is moved to a desired position relative to the fixing plate using the long holes and fixed by a fastener including a bolt, such that the gap covering plate 210 completely covers the gap d having any length between the doorframe and the door, in which the second detection means 240 are disposed at predetermined intervals along a front edge of a third stationary frame 220 and a front edge of the second rotary frame 230, detect a rotational motion of the second rotary frame 230, and transmit a detected signal to the automatic door controller to stop the operation of the door D1 or rotate the door D1 reversely.

The safety system according to the present invention may further include a second door D2 being in contact with the door D1 and configured to slide, in which switch means having the same structure as the first and second switch means are disposed on the second door D2, and a groove portion 140, which is coupled to the elastic protruding portion 130 in a male-female coupling manner, is installed at a front end of the first rotary frame 110 of the second door D2.

In addition, the first detection means 120 and the second detection means 240 may each be selected from a group consisting of an ultrasonic sensor, a push switch, a reed switch, and a magnet switch.

In addition, a plurality of light-emitting means 150 including LEDs disposed at predetermined intervals may be installed at predetermined intervals on a surface of the first rotary frame 110, and the light-emitting means 150 may emit light when the first detection means 120 detects a motion of the first rotary frame 110 or when the door operates.

In addition, a transparent or semi-transparent cover 160 may cover the light-emitting means 150, and the elastic protruding portion 130 may be installed at a front end of the cover 160.

Advantageous Effects

According to the safety system for an automatic door according to the present invention configured as described above, it is possible to prevent a person's finger from getting jammed in the gap between the doorframe and the door and effectively inhibit outside cold air from being introduced into the interior.

In addition, according to the present invention, it is possible to detect whether an object is caught by the moving automatic door, and immediately stop the operation of the automatic door or rotate the automatic door reversely when an object is caught by the automatic door, thereby protecting a passenger so that the passenger is not injured.

In addition, according to the present invention, the person may easily recognize the operating state of the automatic door, thereby preventing an accident that may occur due to the operation of the automatic door.

DETAILED DESCRIPTION OF THE INVENTIONS

Best Mode

Figure 1:
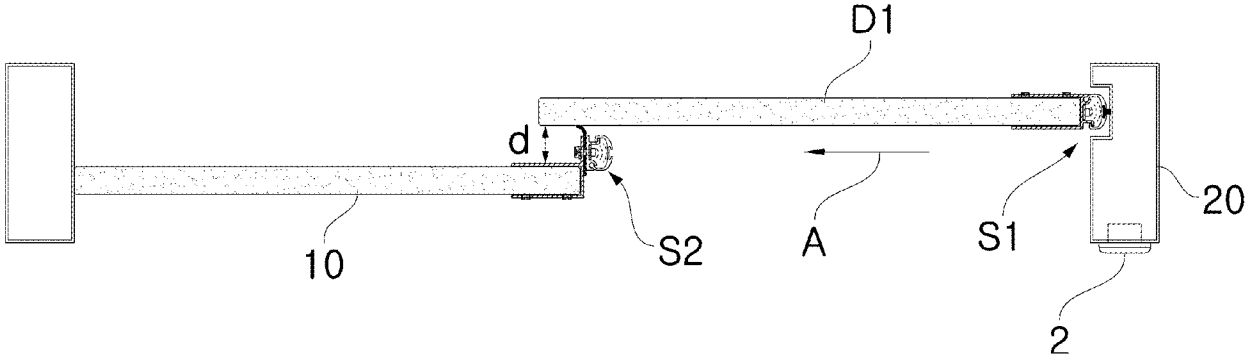
FIG. 1 is a top plan view illustrating an example in which a first embodiment of the present invention is applied to a single basic automatic door.

FIG. 1 is a top plan view illustrating an example in which a first embodiment of the present invention is applied to a single basic automatic door.

As illustrated, a door D1 is disposed at a gap d from a doorframe 10 which is mostly a building wall body. The door D1 is configured to slide and made of a transparent or semi-transparent plate shaped material. A push switch 2 for opening the door D1 is installed on a column 20 with which the closed door D1 is in contact. When the push switch 2 is pushed, the door D1 is opened by moving in a direction indicated by the arrow A.

A first switch means S1 is installed on a front edge of the door D1, i.e., an edge of a lateral end of the door D1 in FIG. 1. A second switch means S2 is installed at a front end of the doorframe 10 to cover a gap d between a surface of the door D1 and the front end of the doorframe 10.

Figure 2A:
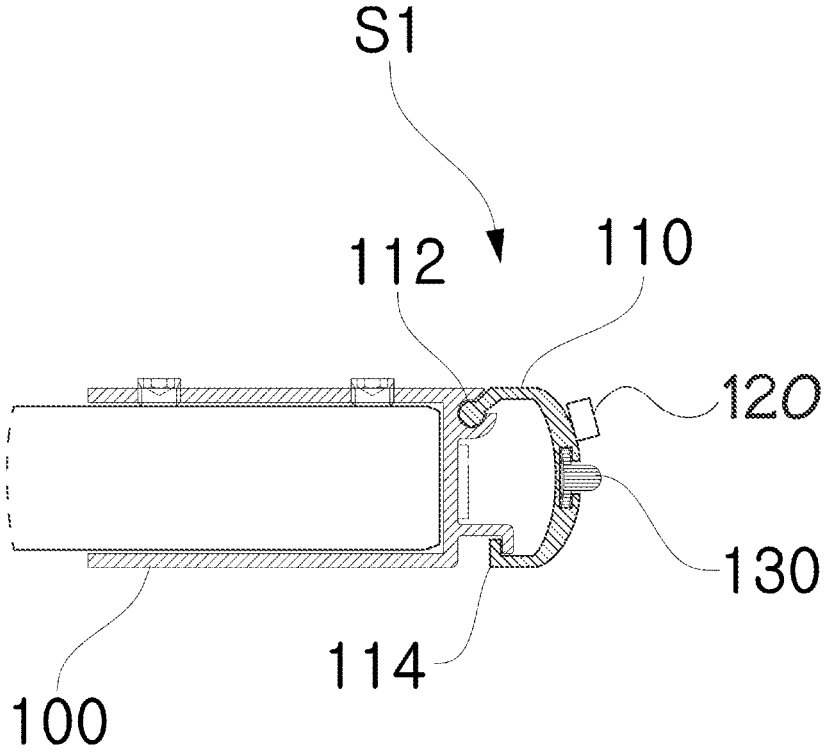
FIG. 2A is a cross-sectional view specifically illustrating a first switch means S1 using a bolt according to the present invention.
Figure 2B:
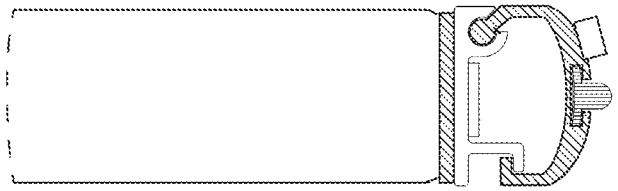
FIG. 2B is a cross-sectional view illustrating an example in which a bonding agent is used.

FIGS. 2A and 2B are cross-sectional views specifically illustrating the first switch means S1.

When the door D1 is viewed from above, the first switch means S1 includes a first stationary frame 100 fixed to the door and configured to surround the front edge of the door D1, a first rotary frame 110 configured to hingedly rotate relative to the first stationary frame, and a first detection means 120 installed in the first rotary frame 110 are configured to detect a motion of the first rotary frame 110. In some instances, an elastic protruding portion 130 may be installed at the front end of the rotary frame 110. The elastic protruding portion 130 may be installed on other portions except for the rotary frame. This configuration will be described below. The first stationary frame 100 may be securely fixed to the door by a fastener such as a bolt (FIG. 2A) or attached to the door by a bonding agent (FIG. 2B).

The first rotary frame 110 may have a cross-section with an arc shape close to a rectangular shape. However, as necessary, the first rotary frame 110 may have any shape such as a square, polygonal, or elliptical shape. The first rotary frame 110 extends along a part or the entirety of a length of the front edge of the first stationary frame 100. One end 112 of the first rotary frame 110 defines a rotation axis of the first rotary frame, and the other end 114 of the first rotary frame 110 is disposed to be movable relative to the front edge of the first stationary frame 100. In the present embodiment, the other end 114 of the first rotary frame 110 has a loop shape and engages with the first stationary frame 100. However, the first rotary frame 110 may be connected to the first stationary frame 100 in other ways. In addition, the first rotary frame 110 may be detachably coupled to the first stationary frame 100.

The first detection means 120 are disposed at predetermined intervals along the front edge of the first stationary frame 100 and detect a rotational motion of the first rotary frame 110. Meanwhile, as necessary, the first detection means 120 may be disposed along the front edge of the first rotary frame 110 instead of the stationary frame. The first detection means 120 is connected to a non-illustrated automatic door controller. The first detection means 120 generates a signal by detecting the rotational motion of the first rotary frame and transmits the signal to the automatic door controller. The automatic door controller may receive the signal and stop the operation of the automatic door or rotate the automatic door reversely. Because a connection relationship between the first detection means and the automatic door controller is well known to those skilled in the art, a description thereof will be omitted. In the present embodiment, the first detection means 120 is provided in the form of an ultrasonic sensor. However, the first detection means 120 may be configured in other ways. This configuration will be described below.

The elastic protruding portion 130 extends along the front end of the first rotary frame 110 and has elasticity to the extent that the elastic protruding portion 130 absorbs impact by being deformed when the elastic protruding portion 130 collides with an object. As necessary, a plurality of elastic protruding portions 130 may be disposed at predetermined intervals or the elastic protruding portion 130 may be disposed only at a portion where a collision most often occurs. However, the elastic protruding portion 130 may extend along an overall length of the first rotary frame 110, if possible, to ensure a windproof effect of blocking the inflow of air from the outside.

Figure 3A:
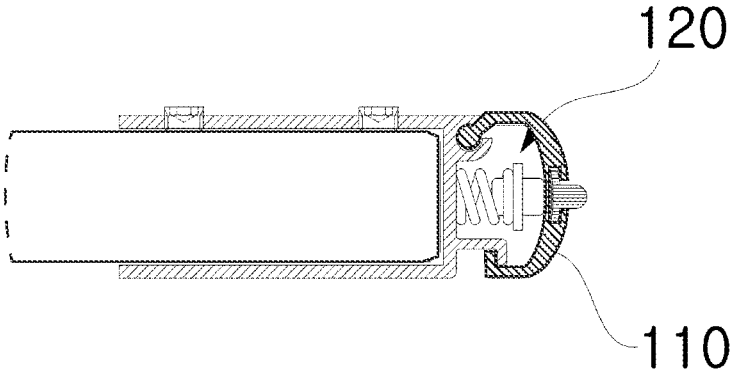
FIGS. 3A to 3C are cross-sectional views illustrating different examples of first detection means.
Figure 3B:
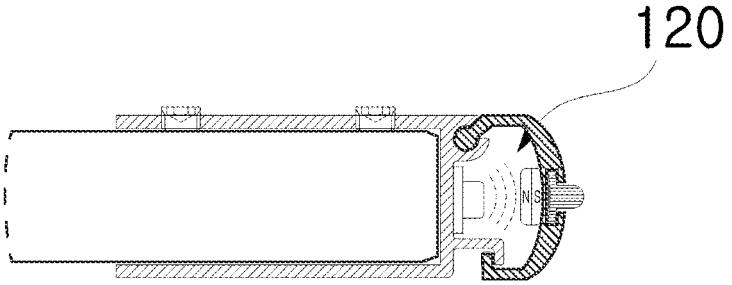

FIGS. 3A to 3B are cross-sectional views illustrating different examples of the first detection means.

Figure 3C:
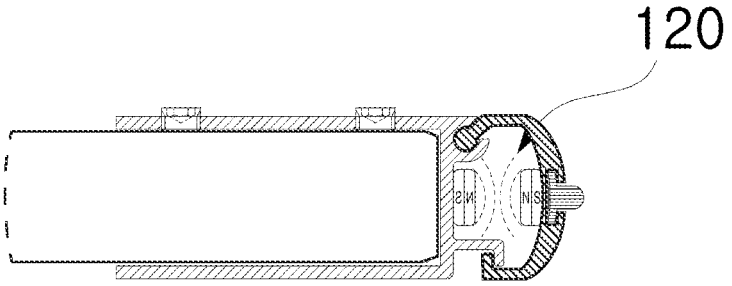

Referring to FIG. 3A, the first detection means 120 is a push switch using elasticity of a spring. That is, when the rotary frame 110 is moved by an external force, the push switch detects the motion of the rotary frame by being pushed inward. The first detection means 120 illustrated in FIG. 3B is a reed switch that is operated by a magnetic circuit of a magnet when the magnet approaches the reed switch. The first detection means 120 illustrated in FIG. 3C is a magnet switch using a repulsive force of two magnets disposed at an interval. Of course, it should be noted that other types of detection means capable of detecting the motion of the rotary frame belong to the scope of the present invention.

Figure 4A:
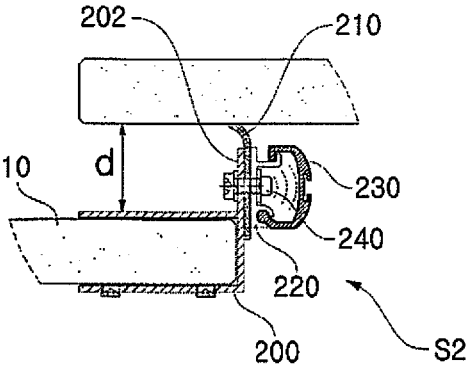
FIG. 4A is a cross-sectional view specifically illustrating a second switch means S2 according to the present invention.
Figure 4B:
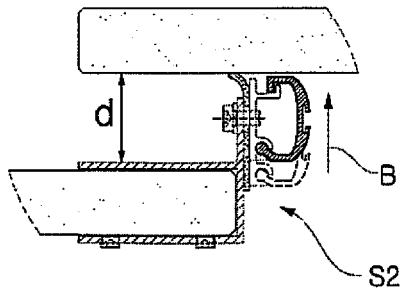
FIG. 4B is a cross-sectional view illustrating an example in which the second switch means S2 is adjusted to be suitable for a gap d.
Figure 4C:
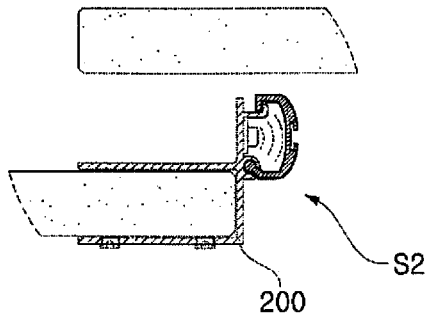
FIG. 4C is a cross-sectional view illustrating another embodiment in which a structure is slightly modified.

FIG. 4A is a cross-sectional view specifically illustrating the second switch means S2 according to the present invention, FIG. 4B is a cross-sectional view illustrating an example in which the second switch means S2 is adjusted to be suitable for the gap d, and FIG. 4C is a cross-sectional view illustrating another example of the second switch means.

As illustrated in FIG. 4A, the second switch means S2 includes a second stationary frame 200 fixed to the doorframe and configured to surround the front edge of the doorframe 10. The second stationary frame 200 has a fixing plate 202 disposed to be perpendicular to the doorframe and protruding toward the door D1. A gap covering plate 210, which is configured as an elastic body, is movably installed on the fixing plate 202 of the second stationary frame 200. Specifically, one or more long holes, which are elongated in a direction perpendicular to the door D1, are formed on any one or both of the fixing plate 202 and the gap covering plate 210, and the gap covering plate may be fixed at a desired position with respect to the fixing plate by a fastener such as a bolt and a nut using the long holes (see FIG. 4B).

A third stationary frame 220 is fixed to the gap covering plate 210, a second rotary frame 230 is installed on the third stationary frame 220, and a second detection means 240 is installed in the second rotary frame 230. The third stationary frame 220, the second rotary frame 230, and the second detection means 240 may have the same structure as the elements corresponding to the first switch means.

The second detection means 240 are also disposed at predetermined intervals along the front edge of the third stationary frame 220. The second detection means 240 detect a rotational motion of the second rotary frame 230 and transmit a detected signal to the automatic door controller, and the automatic door controller may stop the operation of the automatic door or rotate the automatic door reversely. Likewise, as necessary, the second detection means 240 may be disposed along the front edge of the second rotary frame 230 instead of the third stationary frame.

Meanwhile, when the gap d is changed, the gap covering plate 210 may be moved along the long hole in a direction indicated by the arrow B and then installed, such that the second switch means may exhibit its own function even though the gap has any length.

Of course, like the first detection means, the second detection means 240 may be an ultrasonic sensor, a push switch, a reed switch, or a magnet switch.

Meanwhile, as illustrated in FIG. 4C, the third stationary frame may be integrated with the fixing plate 202 of the second stationary frame. In this case, the number of components is reduced, which reduces manufacturing costs. The second rotary frame is installed on the fixing plate 202 having the stationary frame and operates in the same way described above. In this configuration, unlike the embodiment in FIG. 4A, the gap covering plate 210 is disposed at the left side of the fixing plate 202.

The second stationary frame may be fixed to the doorframe by a bolt as illustrated in FIG. 4A, or the second stationary frame may be fixed to the doorframe by a bonding agent as illustrated in FIG. 4C.

Figure 5:
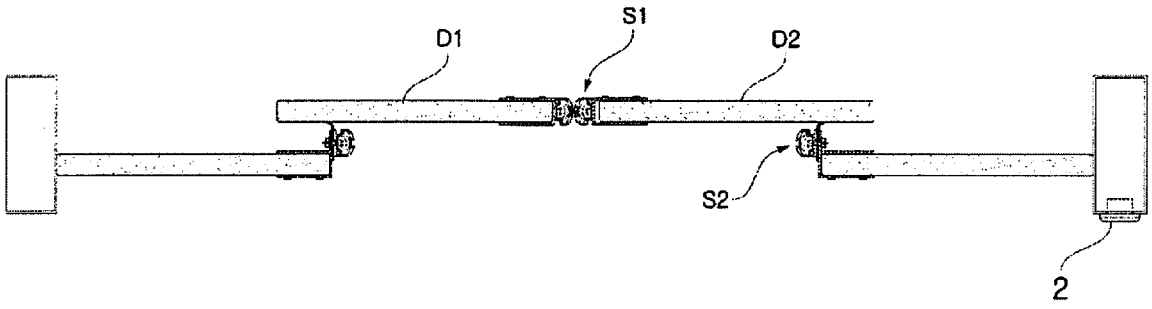
FIG. 5 is a cross-sectional view illustrating an example in which two automatic doors are provided.

FIG. 5 is a cross-sectional view illustrating a second embodiment of the present invention in which two automatic doors are provided.

As illustrated, the present embodiment further includes a second door D2 being in contact with the door D1 and configured to slide. The switch means having the same structure as the first and second switch means are disposed on the second door D2, but an elastic groove portion 140, which is coupled to the elastic protruding portion 130 in a male-female coupling manner, is installed at the front end of the first rotary frame 110 of the second door D2.

Figure 6:
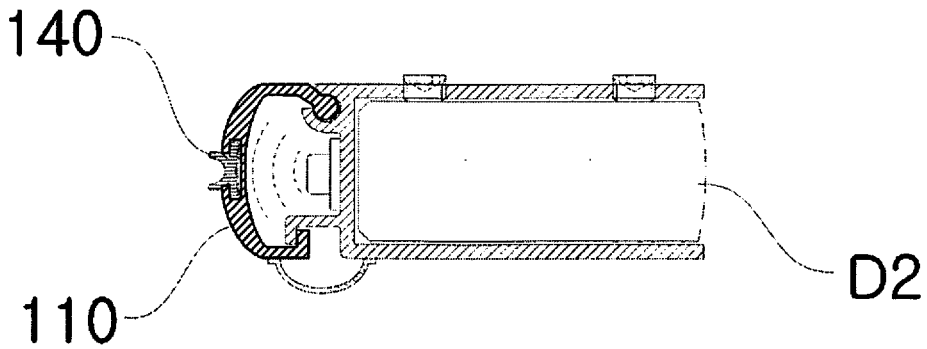
FIG. 6 is a cross-sectional view illustrating a first switch means according to another embodiment of the present invention and specifically illustrating an elastic groove portion of each of the two automatic doors.

FIG. 6 is a cross-sectional view specifically illustrating the groove portion 140.

As illustrated, the structure except for the groove portion 140 is identical to the structure of the first switch means of the door D1. That is, when the two doors are closed, the elastic protruding portion 130 of the door D1 engages with the groove portion 140 of the second door D2 in a male-female coupling manner, which makes it possible to obtain a perfect windproof effect. As illustrated, as necessary, a separate cover may be installed to prevent foreign substances from being trapped in a concave portion.

Meanwhile, as described above, a person who passes through a transparent glass door cannot recognize a motion of the door and gets jammed in the operating door or touches the door with his/her hand, which causes an accident in which the person's finger gets jammed in the gap d. The accident may be prevented by enabling the person to visually or easily recognize the operating state of the door.

Figure 7:
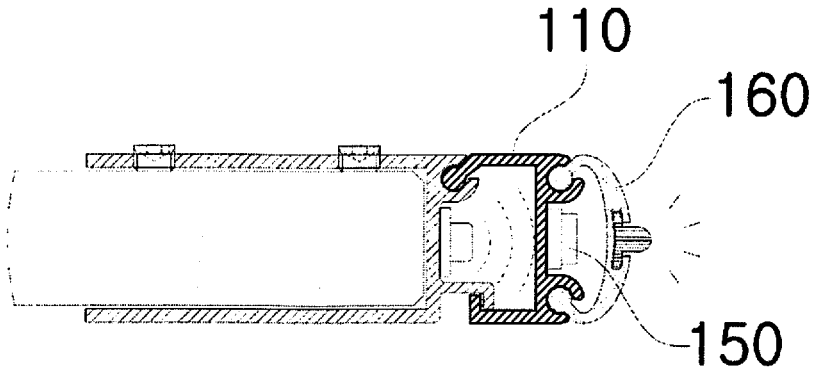
FIG. 7 is a cross-sectional view illustrating an example in which a visual recognition means is further disposed.

To this end, FIG. 7 is a cross-sectional view illustrating an example in which a visual recognition means is further disposed.

As illustrated, a plurality of light-emitting means 150 including LEDs disposed at predetermined intervals may be installed at predetermined intervals on an outer surface of the first rotary frame 110. A transparent or semi-transparent cover 160 covers the light-emitting means 150 to protect the light-emitting means 150 from external impact, and the elastic protruding portion 130 is installed on the front end of the cover 160. Of course, the light-emitting means 150 may emit light when the first detection means 120 detects the motion of the first rotary frame 110.

The invention claimed is:

1. A safety system for an automatic door comprising:

a first switch installed along a front edge of the automatic door, wherein the first switch comprises:

a first stationary frame fixed to the automatic door and configured to surround the front edge of the automatic door;

a first rotary frame configured to hingedly rotate relative to the first stationary frame; and an ultrasonic sensor installed in the first rotary frame and configured to detect a motion of the first rotary frame;

wherein the first rotary frame extends along a part or an entirety of a length of a front edge of the first stationary frame, a first end of the first rotary frame is rotatably coupled to the first stationary frame and defines a rotation axis of the first rotary frame to enable the first rotary frame to hingedly rotate relative to the first stationary frame, and a second end of the first rotary frame engages with the first stationary frame to enable the first rotary frame to move relative to the front edge of the first stationary frame, and wherein when a front edge of the first rotary frame collides with an external object and the first rotary frame rotates about the rotation axis, the ultrasonic sensor detects the rotational motion of the first rotary frame and transmits a detected signal to an automatic door controller to stop an operation of the automatic door.

2. The safety system of claim 1, wherein the first rotary frame has an arc-shaped cross-section, and the ultrasonic sensor is disposed at predetermined intervals along the front edge of the first stationary frame or the front edge of the first rotary frame.

3. The safety system of claim 1, further comprising:

an elastic protruding portion installed on the front edge of the first rotary frame, wherein the elastic protruding portion extends along the front edge of the first rotary frame.

4. The safety system of claim 3, further comprising:

a second switch installed at a front end of a doorframe to cover a gap between a surface of the door and the front end of the doorframe, wherein the second switch comprises:

a second stationary frame fixed to the doorframe, configured to surround the front end of the doorframe, and having a fixing plate extending perpendicular to the doorframe and protruding toward the door;

a gap covering plate movably installed on the fixing plate of the second stationary frame;

a second rotary frame installed on the fixing plate and configured to hingedly rotate relative to the fixing plate; and a second ultrasonic sensor installed in the second rotary frame and configured to detect a rotational motion of the second rotary frame;

wherein a plurality of holes are formed in at least one of the fixing plate and the gap covering plate, and the gap covering plate is moved to a desired position relative to the fixing plate and fixed thereto by a bolt, such that the gap covering plate covers the gap between the front end of the doorframe and the surface of the door; and wherein the second ultrasonic sensor is disposed along a front edge of a third stationary frame, and wherein when the second ultrasonic sensor detects the rotational motion of the second rotary frame, the second ultrasonic sensor transmits a detected rotational motion signal to the automatic door controller to stop the operation of the door.

* * * * *